United States Patent [19]

Ammen et al.

[11] Patent Number: 4,704,979

[45] Date of Patent: Nov. 10, 1987

[54] SAIL SYSTEM

[76] Inventors: Mark E. Ammen, 1204 Lattie La., Mill Valley, Calif. 94941; William D. Hansen, 1906 Vine St., Berkeley, Calif. 94709

[21] Appl. No.: 801,942

[22] Filed: Nov. 26, 1985

[51] Int. Cl.[4] ..... B63H 9/04

[52] U.S. Cl. ..... 114/98; 114/97; 114/102; 114/103

[58] Field of Search ..... 114/39, 111, 89, 90, 114/97, 98, 102, 103, 106–108

[56] References Cited

U.S. PATENT DOCUMENTS

| | | | |
|---|---|---|---|
| 2,107,303 | 2/1938 | Jungstrom | 114/106 |
| 4,059,063 | 11/1977 | Hood | 114/102 |
| 4,335,669 | 6/1982 | Hackney | 114/103 |
| 4,367,688 | 1/1983 | Godfrey | 114/39 |
| 4,418,632 | 12/1983 | Yoshimi | 114/102 |
| 4,474,126 | 10/1984 | King | 114/39 |
| 4,505,217 | 3/1985 | Endo | 114/103 |
| 4,563,969 | 1/1986 | Le Bail | 114/102 |

*Primary Examiner*—Joseph F. Peters, Jr.
*Assistant Examiner*—Clifford T. Bartz

[57] ABSTRACT

A sail system for a sailboat having a stayed, non-rotatable mast includes first and second booms, a single sail suspended from said masthead, the sail having a shape such that, with the vertical midline of the sail positioned along the mast, a generally triangular sail portion is formed on the port side of the sailboat and a second, symmetrical, sail portion is formed on the starboard side, both said starboard and port sail portions having substantial roach areas; and backstay means connected between said masthead and the stern portion of the sailboat to bend the masthead aft.

9 Claims, 5 Drawing Figures

SAIL SYSTEM

BACKGROUND OF THE INVENTION

1. Field of the Invention

The present invention relates to a sail system for a sailing craft and, more particularly, to a sail system for a sailboat having a non-rotatable mast.

2. State of the Art

It is well known that the optimum size and shape of a sail for downwind sailing (i.e., sailing before the wind) is substantially different than the optimum sail shape for upward sailing (i.e., sailing against the wind). For downwind sailing, especially in light wind conditions, a craft of a given size can usually carry more sail area than in upwind sailing conditions. Accordingly, for downwind sailing in light wind conditions, many sailing craft utilize a headsail, some types which are referred to as spinnakers, which are attached in front of the mainsail.

One variation to the above-described prior art has been proposed in U.S. Pat. No. 2,107,303 to Ljungstrom. In that patent, the patentee suggests attaching two sails to a single mast so that, when sailing before the wind, the two sails stand out like a parachute sail and, when sailing upwind, the two sails can be doubled against one another to form an ordinary triangular sail. According to the patentee, the mast should be rotatable so that the sails can be rolled about the mast to selectively change the effective sail area depending upon wind conditions. (Sail adjustment of the effective sail area is often referred to as reefing.) Further, the patentee suggests that several generally vertical laths be mounted in the sail; the vertical orientation of the laths is critical to the ability to roll the sail upon the mast for reefing.

Another variation on the prior art attempting to obviate the need for headsails is proposed in U.S. Pat. No. 4,230,060 to McCoy. Similarly to Ljungstrom, the McCoy patent suggests attaching two sails to a mast and providing the mast with a rotation mechanism so that the two sails can be selectively reefed by rotating the mast. In the McCoy patent, the sails are without laths or battens which, apparently, would interfere with rotation of the mast for reefing.

Yet another sailing system utilizing two sails attached to a rotatable mast has been proposed in U.S. Pat. No. 4,367,688 to Godfrey. Godfrey suggests that a sailboat can be provided with twin booms, a doubled triangular sail and a rotatable mast to permit conventional sailing with both booms and sail sections on the same tack or with the booms spread, wind-like, to permit running before the wind or reaching. The rotatable mast suggested by Godfrey permits the sails to be reefed or furled by rotation of the mast. In the Godfrey patent, the sails are also without laths or battens.

In an article appearing in *Cruising World* in August 1984, pages 98 and 99, there is a report of a sailboat designed by Thomas Godfrey. According to the article, the sail system for the sailboat basically consists of an unstayed spar of tapered elliptical section and a two-ply, wrap-around sail that can be reefed or furled by rotating the spar i.e., the mast). A sailing craft is pictured in the article including the so-called two-ply, wrap-around sail. The pictured sail does not include laths or battens, and that the mast is unstayed.

In U.S. Pat. No. 4,474,126 to King, there is proposed a sailing rig for use on a sailboat comprising a sail formed in the shape of two approximately ellipsoidal portions mounted upon a mast rotatable about its vertical axis. The rotatable mast in the King patent is unstayed but is permanently curved near its top. According to the patentee, the sail system oprates such that, when the sailboat is close-hauled, the sail folds around the mast and when the sailboat runs before the wind, the sail unfolds and opens to fly free of the mast. Further, the patentee suggests that the roach curve can be supported by battens arranged in a suitable configuration. Still further, the patentee suggests that, when the sail is folded around the mast, the foot of the sail at its centerline can be attached to a down-haul line for tensioning the luff of the sail.

OBJECTS AND SUMMARY OF THE INVENTION

A primary object of the present invention is to provide an improved sail system for a sailboat having a stayed, non-rotatable mast.

Another object of the present invention is to provide an improved sail system for a sailboat having a stayed, non-rotatable mast wherein the sail system provides substantially increased sail area for downwind sailing and reduced sail area with a generally elliptic planform for upwind sailing.

Yet another object of the present invention is to provide an improved sail system for a sailboat having a stayed, non-rotatable mast wherein the sail system provides substantially increased sail area for downwind sailing or reaching, and reducible sail area with a fully-battened, generally elliptic shape in planform for upwind sailing.

In accordance with the preceding objects, the present invention provides a sail system for a sailboat having a stayed mast, with one end non-rotatably mounted to the sailboat and tapering thereafter to a narrow masthead. The sail system comprises a pair of booms pivotably secured to the mast; a single sail suspended from the masthead and having a shape such that, with the midline of the sail positioned about the mast, a sail portion with a generally elliptic planform is formed on the port side of the sailboat and a symmetrical sail portion is formed on the starboard side, a plurality of battens mounted at spaced-apart locations in the starboard and port sail portions to provide curved shape to the sail portions; first outhaul means to attach the clew of the port sail portion to one of the booms and second outhaul means to attach the clew of the starboard sail portion to the other boom such that said midline of the sail can be held toward the mast; and means to independently control movement of the two booms; and backstay means connected between said masthead and the stern portion of the sailboat to bend the masthead aft.

In accordance with the preceding, an advantage of the present invention is the provision of an improved sail system for a sailboat having a stayed, non-rotatable mast.

Another advantage of the present invention is the provision of a sail system for a sailboat having a stayed, non-rotatable mast to provide substantially increased sail area for downwind sailing or reaching, and reduced sail area with a generally elliptic planform for upwind sailing.

Still another advantage of the present invention is the provision of an improved sail system for a sailboat having a stayed, non-rotatable mast wherein the sail system provides substantially increased sail area for downwind sailing and reducible sail area with a fully-battened, generally elliptic shape in planform for upwind sailing.

These and other objects and advantages of the present invention will no doubt become obvious to those of ordinary skill in the art after having read the following detailed description of the preferred embodiment which is illustrated in the various drawing figures.

IN THE DRAWINGS

DETAILED DESCRIPTION OF THE PREFERRED EMBODIMENT

Figure 1:
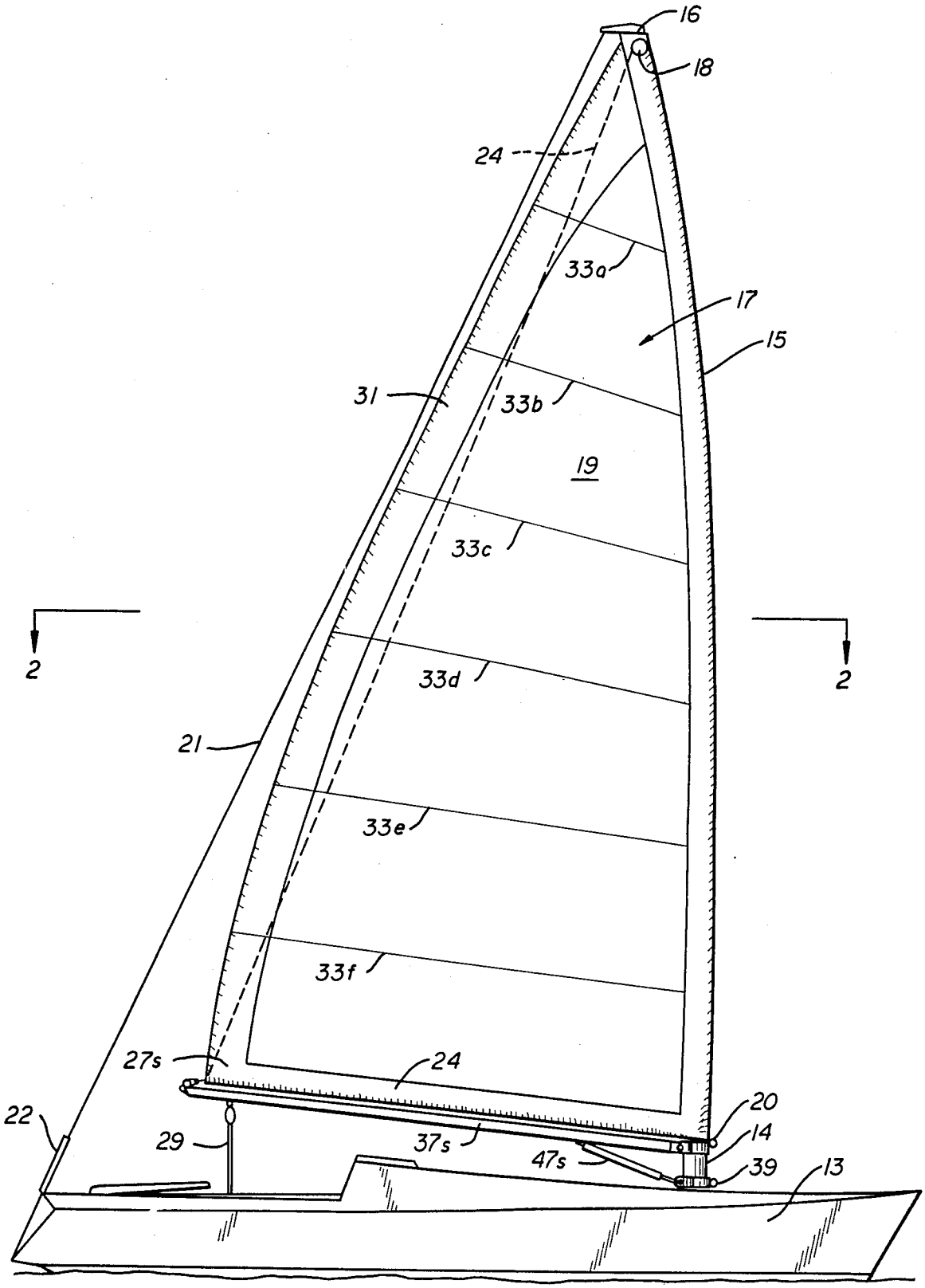
FIG. 1 is a side view of a sailboat in an upwind sailing position and employing a sail system, shown in planform, according to the present invention.

In the embodiment shown in FIG. 1, a sailboat includes a hull 13, a single mast 15 fixedly secured to the hull 13, and a sail system generally designated by the number 17 fitted to the mast 15 and including a sail 19. The mast 15 is non-rotatably fixed to the hull 13 and tapers to a narrow masthead 16. In practice, a conventional halyard 18 is provided at the masthead 16 to hoist the sail 19 for securement at the masthead 16. The sail system 17 includes a backstay line 21 connected between the masthead 16 and the stern portion of the hull 13. An adjustment means, such as a block 22, is connected to selectively shorten the backstay 21 thereby to force the masthead 16 to bend aftward; in practice, the aftward arc of the mast is about ten percent of the total luff length.

The portion of the sail 19 shown in FIG. 1 has, generally speaking, an elliptic shape in planform. The foot 24 of the sail 19 is defined as the portion which extends from the mast 15 to the clew 27*s*. FIG. 1 further shows a main sheet 29 whose function is essentially conventional, as will be further described hereinafter. Still further, FIG. 1 shows a dashed straight line 24 drawn from the masthead of the sail 19 to the clew 27; this line represents the hypotenuse of the generally triangular sail shape. The portion 31 of the sail which extends aftward beyond the hypotenuse line is known as the roach, and the edge of the roach portion of the sail is known as the leech.

Figure 2:
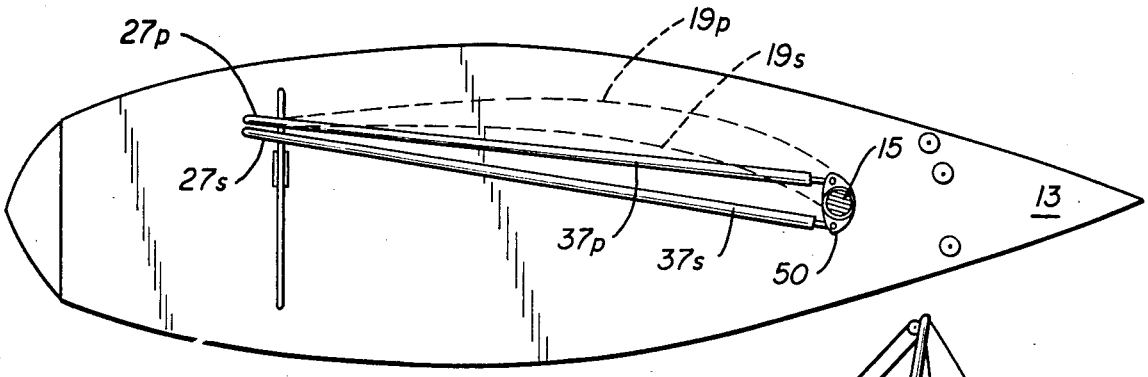
FIG. 2 is a plan view taken in section along the line 2—2 in FIG. 1 for viewing in the direction of the arrows.

FIG. 1 further shows a plurality of battens 33*a*, 33*b*, 33*c*, etc., mounted to the sail 19 at spaced-apart locations to extend generally toward the mast 15. Because the battens 33*a–f* extend from the leech to the mast, the sail 19 is said to be fully battened. The battens are ordinarily fitted in narrow pockets (not shown), sewn to the surface of the sail 19. In practice, the battens 33*a–f* are placed under compression along their length so that, as shown in FIG. 2, the leading edge of the sail 19 (i.e., the luff portion) has a generally curved shape providing draft even in the absence of wind pressure. Such compression of the battens 33*a–f* is accomplished by means, for example, of conventional straps and buckles arranged at the roach ends of the batten pockets such that, when a strap is secured to a buckle, the associated batten is forced toward the mast 15 and takes on a curved shape. In practice, the draft can be enhanced by tapering the portion of the batten adjacent to the mast 15.

FIG. 1 also shows a boom 37*s* which is connected to the mast 15 to extend to a distal end near the clew 27*p*. The boom 37*s* is additionally supported near the mast 15 by a linkage 47*s*, commonly referred to as a vang. Also, FIG. 1 shows a downhaul system 39, comprising a pair of pulleys and interconnecting lines, to connect the foot or tack of the sail 19 to the base of the mast 15.

Only the starboard portion of the sail 19 is shown in FIG. 1; the port portion, which is symmetrical with the starboard portion and likewise fully battened, extends aftward from the port side of the mast 15 as shown in FIG. 2. FIG. 2 also shows a boom 37*p* which extends from the mast 15 to a clew 27*p* on the port portion of the sail 19. (Components on the port side of the sailboat are designated by the subscripts "p" and components that are associated with the starboard side are designated with the subscripts "s".) Thus, as shown in FIG. 2, the spaced-apart port and starboard portions of the fully battened sail 19 provide a windlike shape when the sail is positioned for upwind sailing.

Figure 3:
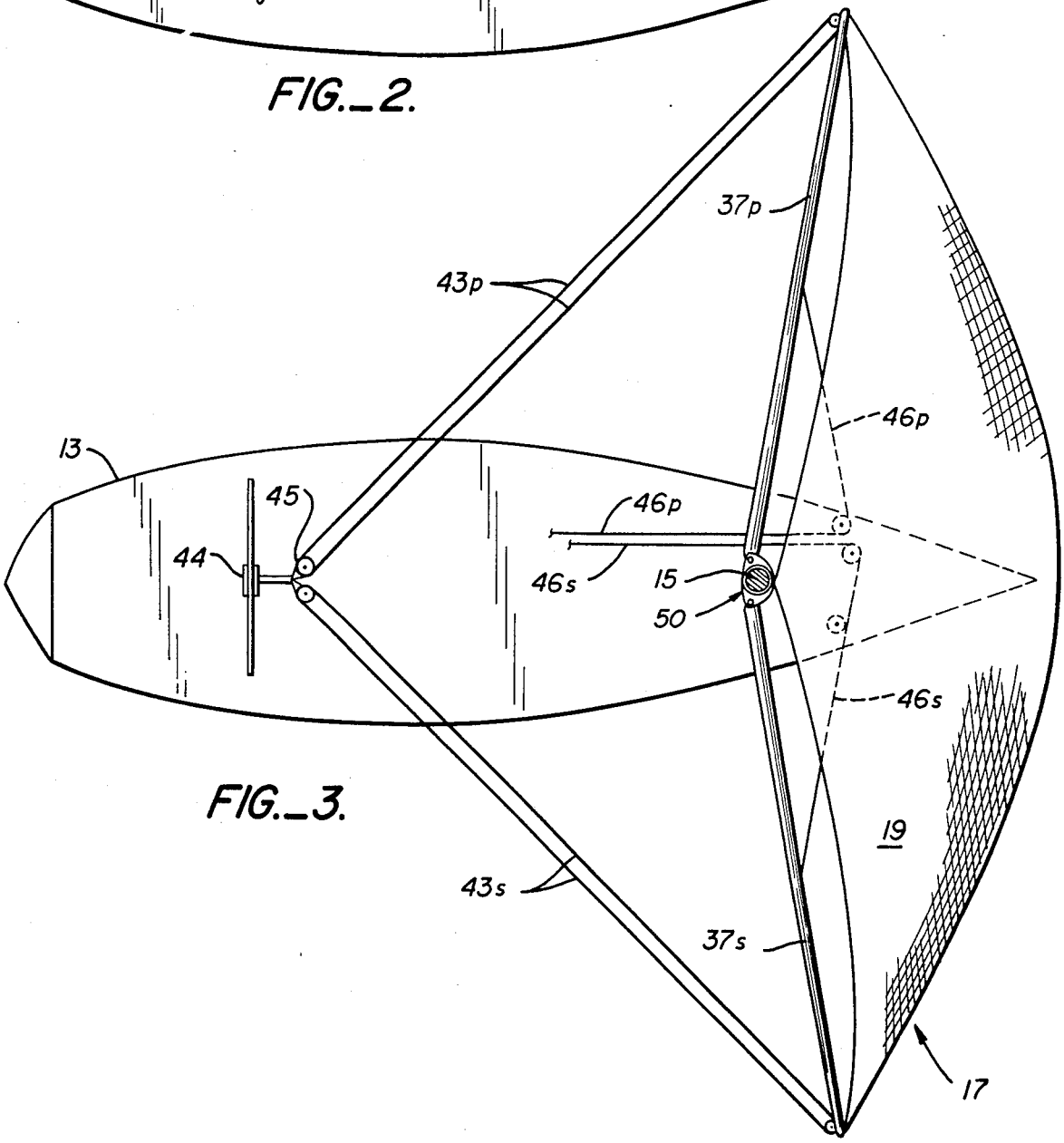
FIG. 3 is a plan view of the sailboat of FIG. 1 with the sail system of the present invention in a position for downwind sailing.

FIG. 3 shows the sail system 17 in a position for downwind sailing. In this condition, the booms 37*p* and 37*s* are pivoted apart to form a reflex angle relative to one another, and the sail 19 is entirely forward of the mast 15. FIG. 3 also shows a pivot means, generally designated by the number 50, which pivotly connects the booms 37*p* and 37*s* and vangs 47*s* and 47*p* to the mast 15; in practice, the mast 15 is stationary and non-rotating relative to the pivot means 50. Further, FIG. 3 shows sheets 43*p* and 43*s* connected between the stern portion of the hull 13 and the respective distal ends of the booms 37*p* and 37*s*. The sheet 43*p* is referred to as the port trimmer sheet, and the sheet 43*s* is referred to as the starboard trimmer sheet. The port and starboard trimmer sheets 43*p* and 43*s* are connected at a splitter mechanism 45. Also shown in FIG. 3 are starboard and port foreguys 46*s* and 46*p*, respectively, which are connected between the bow of the sailboat 13 and the respective starboard and port boom 37*s* and 37*p*. The purpose of the foreguys 46*s* and 46*p* is to allow respective booms 37*s* and 37*p* to be hauled forward to place the sail 19 in the open, downwind condition.

Figure 4:
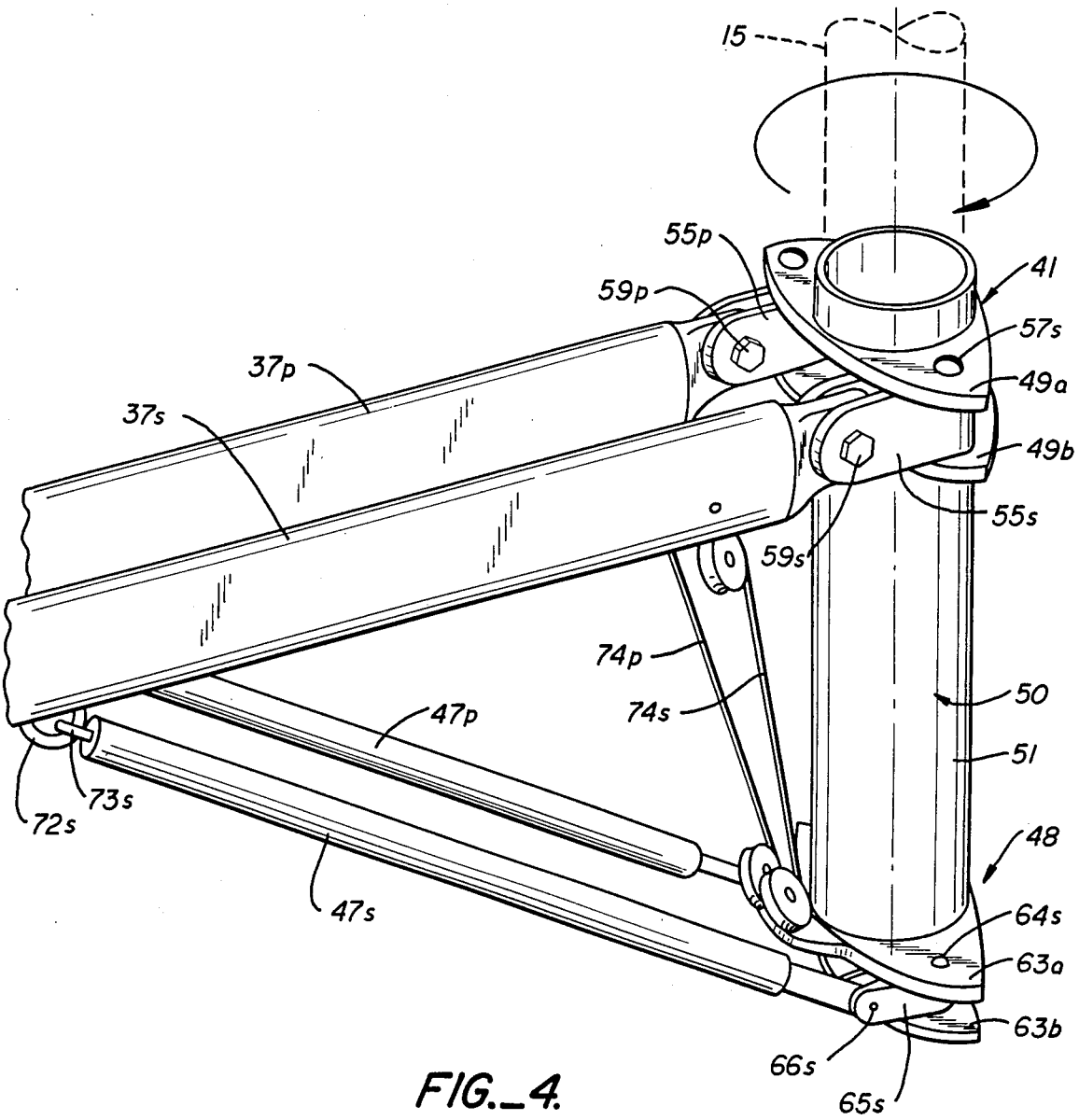
FIG. 4 is a pictorial view of a section of the mast and booms utilized with the sail system of the preceding drawings.

FIG. 4 shows details of the boom and vang pivot means 50, the vangs 47*p* and 47*s*. The boom pivot means 50 includes a collar-like member 51 having upper and lower spaced-apart tang plates 49*a* and 49*b* fixed about the collar 51 to extend horizontally outward to the port and starboard sides of the non-rotatable mast 15. In practice, the collar-like member 51 is mounted to the mast 15 at a location slightly below the foot of the sail 19 and is free to rotate about the mast. On the starboard side, a clevis 55*s* is pivotably fixed between the tang plates 49*a* and 49*b* by a generally vertical pivot pin 57*s*; likewise, on the port side, a clevis 55*p* is pivotally fixed between the tang plates 49*a* and 49*b* by a generally vertical pivot pin (not shown). The starboard boom 37*s* is pivotably connected between the legs of the clevis 55*s* by a generally horizontal pivot pin 59*p* and, likewise, the port boom 37*p* is pivotably connected between the ends of the clevis 55*p* by a generally horizontal pivot pin 59*p*. As so mounted, the booms 37*p* and 37*s* are free to rotate in both horizontal and vertical planes relative to the mast 15 and, in addition, the booms 37*p* and 37*s* are free to rotate about the mast with the collar-like member 51.

Referring still to FIG. 4, the vangs 47*p* and 47*s* are pivotably connected to the collar 51 by vang pivot means 48 located below boom pivot means generally designated 41. The vang pivot means 48 has upper and lower spaced-apart tang plates 63*a* and 63*b*, respectively, fixed to the collar-like member 51 to extend horizontally outward to the port and starboard sides of the mast 15. On the starboard side, a clevis 65*s* is pivotably fixed between the upper and lower tang members 63*a* and 63*b* by a generally vertical pivot pin 64*s*. The starboard vang 47*s* is pivotably mounted between the legs of the clevis 65*s* by a generally horizontal pivot pin 66*s* so that the vang is free to pivot in a vertical plane relative to the legs of the clevis. Likewise, on the port side, the port vang 47*p* is pivotably mounted between the legs of a pivotable clevis (not shown). As so mounted, the vangs 47*p* and 47*s* are free to pivot in horizontal and vertical planes, and are free to rotate about the mast 15 with the collar-like member 51. The opposite ends of the vangs 47*s* and 47*p* are connected to the respective boom 37*s* and 37*p* by universal joints comprised, for example, of interconnected shackles 72*s* and 73*s*.

Figure 5:
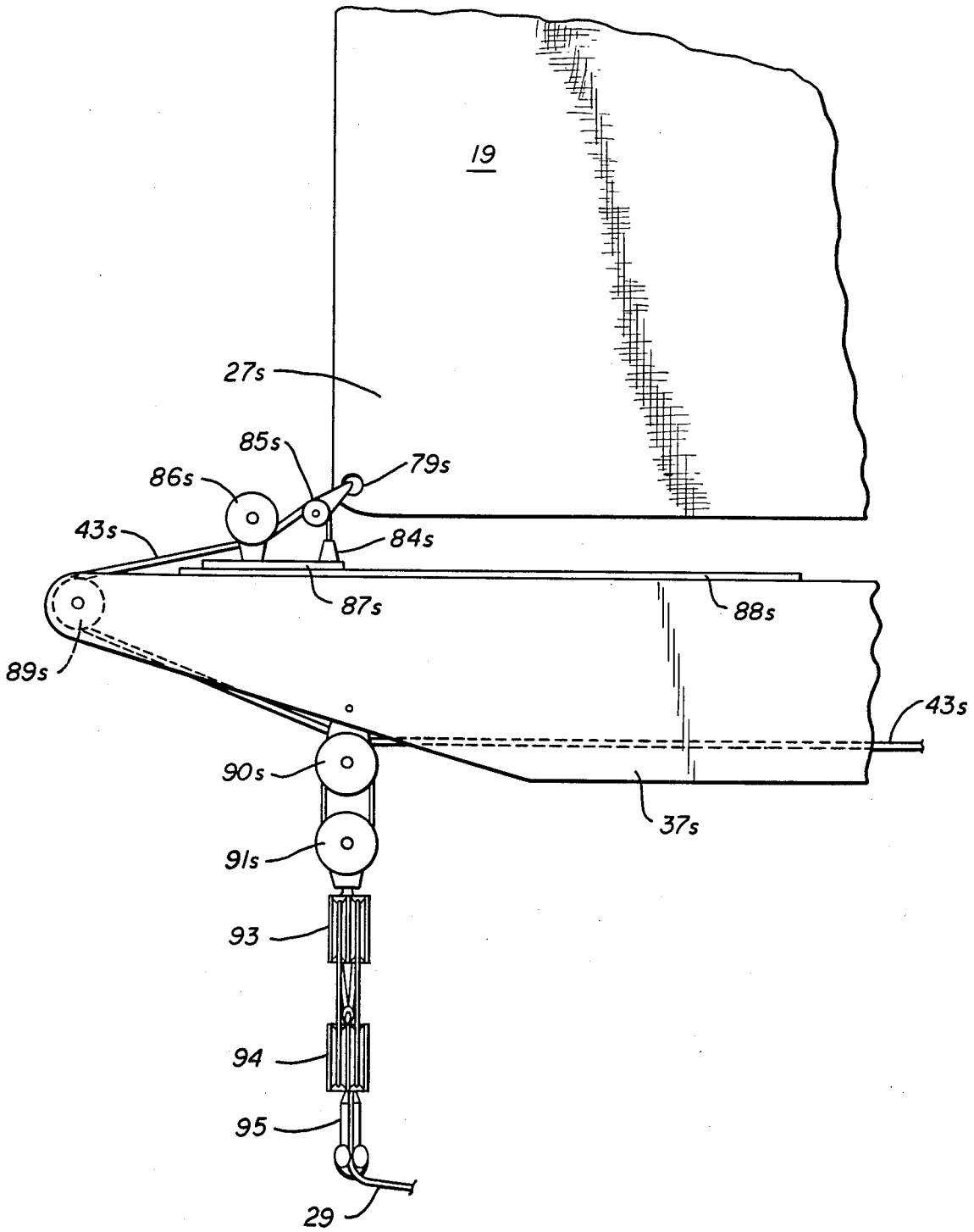
FIG. 5 is a pictorial view of the distal ends of the booms and an associated mechanism utilized with the sail system of the preceding drawings.

FIG. 5 shows one manner of attachment of the end of the boom 37*s* to the clew 27*s*. More particularly, FIG. 5 shows trimmer sheet 43*s* extending from a bail 84*s* through a block 85*s* fixed to the clew 27*s*. Further, trimmer sheet 43*s* extends through a block 86*s* mounted to a car 87*s* slidably mounted on a track 88*s* fixed to the boom 37*s*. As so attached, the clew 27*s* can move lengthwise of the boom 37*s* as the car 87*s* slides along the track 88*s*. Conventional means, not shown, can be provided to selectively position the cars 87*s* and 87*p* on respective tracks 88*s* and 88*p* on respective booms 37*s* and 37*p*. The trimmer sheet 43*s* is fitted through sheaves 89*s* and 91*s* so that the trimmer sheet 43*s* can be controlled from the cockpit of the sailboat hull 13. Together, the splitter sheets 43*s* and 43*p* determine the extent to which the starboard and port booms 37*s* and 37*p* are angularly separated from one another when foreguys 46*s* and 46*p* are in tension.

Further, FIG. 5 shows means to connect the starboard and port splitter sheets 43*s* and 43*p*, respectively, to the main sheet 29. In the illustrated embodiment, such means comprises a pair of double blocks 93 and 94 through which the main sheet 29 is trained, with the double block 93 being connected by an appropriate shackle to both the starboard sheave 91 and the corresponding port sheave (not shown). To provide further mechanical advantage, a third block 95 can be included in the main sheet control system.

The function and operation of the improved sail system of the present invention can now be readily understood. To fit the sailboat with the sail 19, the mast 15 is non-rotatably fixed to the hull 13 and the sail 19 is hoisted to the masthead 16 by the halyard 18. To further fit the sail 19, the downhaul system 39 (FIG. 1) is attached to secure the tack of the sail 19 to the base of the mast 15, and the clews 27*s* and 27*p* (FIG. 5) are attached to the respective cars 87*s* and 87*p* at the free ends of the booms 37*s* and 37*p*, respectively. To complete the fitting of the sail 19, the backstay line 21 is tensioned to bend the mast 15 aftward, the trimmer lines 43*s* and 43*p* are tensioned to outhaul the clews 27*s* and 27*p*, respectively, and the battens 33*a–f* are compressibly placed in the starboard and port sail portions. With the battens so placed, the luff portions of the sail take on a wind-like shape as shown in FIG. 2, even in the absence of wind pressure.

At this juncture, it may be appreciated that the sail 19 is attached to the mast 15 at the masthead 16, and at the base of the mast by the downhaul system 39, and at the respective starboard and port clews 27*s* and 27*p* via the cars 87*s* and 87*p*. Accordingly, with a windload when sailing upwind (FIG. 2), the sail 19 is free to move about the mast 15 to self-adjust to a position at which the sail configuration is optimum for the wind conditions. During such self-adjusting action, the curved cross-sectional shape of the luff of the sail 19 is maintained by the battens 33*a–33f*. Further, the starboard and port sail shapes and leech tensions can be independently refined and adjusted by selective starboard and port movement of the cars 87*s* and 87*p* and by tensioning the respective starboard and port trimmer sheets 43*s* and 43*p*.

For ordinary upwind sailing, the booms 37*s* and 37*p* are arranged generally parallel to one another as shown in FIG. 2. The vertical angle of the booms 37*s* and 37*p* is determined by the vangs 47*s* and 47*p*, respectively. The free ends of the booms 37*s* and 37*p* are maintained together by the splitter mechanism 45. In the upwind sailing condition, the sail system is maintained in relatively high tension, especially along the leech. Such tension is accomplished by the aftward biasing of the mast 15, to provide a preload, and by the battens 33*a*, 33*b*, etc., and by the action of the mainsheet 29. It should be noted that leech tension in the above-described sail system can be preset and maintained independent of the draft (i.e., curvature as shown in FIG. 2) of the sail. In fact, the draft of the sail system is primarily determined by the positions of the cars 87*s* and 87*p* on the respective tracks 88*s* and 88*p*, and by the positions of the associated boom 43*s* and 43*p*.

For downwind sailing, as shown in FIG. 3, the trimmer sheets 43*s* and 43*p* and payed out and the respective foreguys 46*s* and 46*p* are tensioned so that the respective booms 37*s* and 37*p* move apart from one another to a reflex angle position. Under such conditions, the sail 19 floats forward of the mast 15 and takes the shape of a large, fully battened spinnaker sail. Also under such conditions, the downhaul system 39 may be payed out to let the tack of the sail 19 move toward the bow of the sailboat, with the vangs 47*s* and 47*p* continuing to support the respective booms 37*s* and 37*p*. Also in the downwind or reaching sailing condition, the distances between the clew 27*s* and the boom 37*s*, as well as the distance between the clew 27*p* and the boom 37*p* are maintained constant, but the sail shapes can be tuned by moving the travelling cars 87*s* and 87*p* on the respective booms 37*s* and 37*p*.

It can be appreciated that reefing of the sail 19 for upwind sailing can be accomplished with the booms 37*s* and 37*p* in the close position by lowering the masthead halyard 18.

Although the present invention has been described with particular reference to the illustrated preferred embodiments, it is to be understood that such disclosure is not to be interpreted as limiting. Various other alterations, modifications and embodiments will no doubt become apparent to those skilled in the art after having read the preceding disclosure. Accordingly, it is intended that the appended claims be interpreted as covering all such alterations, modifications and embodiments as fall within the true spirit and scope of the present invention.

We claim:

1. An improved sail system for a sailboat comprising:

(a) an upstanding mast that is non-rotatably mounted to the sailboat and tapers from the mounted end to a narrow masthead;

(b) first and second booms pivotably secured at a lower portion of the mast to have at least two degrees of pivotal freedom;

(c) a single sail suspended from said masthead, the sail having a shape such that, with the vertical midline of the sail positioned along the mast, forms a sail portion on the port side of the sailboat and a second, symmetrical, sail portion on the starboard side, with both said starboard and port sail portions having substantial roach areas and luff curvatures;

(d) a plurality of battens mounted at spaced-apart locations in said starboard and port sail portions to extend substantially toward the mast, and means to place the battens under compression such that said luff areas of the starboard and port sail portions each maintain a curved shape;

(e) first outhaul means to attach the clew of said starboard sail portion to the first boom, and second outhaul means to attach the clew of said port sail portion to the second boom such that the vertical midline of the sail can be held against the mast;

(f) first and second means to control, respectively, movement of said first and second booms; and (g) backstay means connected between said masthead and a stern portion of the sailboat to bend the masthead aft.

2. An improved sail system according to claim 1 including downhaul means connecting the tack of the sail to the mast.

3. An improved sail system according to claim 2 wherein battens of the plurality extend from the leech portions to positions adjacent the mast to provide shape to the roach areas and luff sections of both the starboard and port portions of the sail.

4. An improved sail system according to claim 3 wherein the first and second booms are independently supported by first and second vangs.

5. An improved sail system according to claim 3 wherein the first outhaul means includes attachment means to adjustably fix the distance from the clew of the starboard sail portion to the first boom, and wherein the second outhaul means includes attachment means to adjustably fix the distance from the clew of the port sail portion to the second boom.

6. The improved sail system of claim 2 wherein the points of attachment of the sail portions to the mast are at the masthead and at the downhaul means so that, under wind load, the respective starboard and port sail sections are free to move about the mast to assume a self-adjusted position.

7. An improved sail system according to claim 5 wherein said first and second outhaul means include adjustment means for selective adjustment of the position of the clews of the starboard and port sail sections along the lengths of the starboard and port booms, respectively.

8. An improved sail system for a sailboat comprising:

a mast non-rotatably mounted to the sailboat;

first and second booms pivotably secured to a lower portion of the mast to have at least two degrees of pivotal freedom;

a single sail suspended from said masthead, the sail having a shape such that, with the vertical midline of the sail positioned along the mast, a sail portion that is generally elliptic in planform is formed on the port side of the sailboat and a second, symmetrical, sail portion is formed on the starboard side with both said starboard and port sail portions having substantial roach areas and luff curvatures;

a plurality of battens mounted at spaced apart locations in the starboard and port sail portions to extend substantially toward the mast, and means to place the battens under compression such that said luff areas of the starboard and port sail portions each maintain a curved shape;

first travelling outhaul means to attach the clew of said starboard sail portion to the first boom and second travelling outhaul means to attach the clew of said port sail portion to the second boom such that the vertical midline of the sail can be adjustably held toward the mast, the first travelling outhaul means includes attachment means to adjustably maintain the distance from the clew of the starboard sail portion to the first boom while permitting the clew to be moved adjustably along the first boom, and the second outhaul means includes attachment means to adjustably maintain the distance from the clew of the port sail portion to the second boom while permitting the clew to be adjustably moved along of the second boom; and backstay means connected to the masthead to bend the mast aft.

9. The improved sail system of claim 8 wherein points of attachment of the sail portions to the mast are at the masthead halyard and at the downhaul means so that, under wind load, the respective starboad and port sail sections are free to move about the mast to a self-adjusted position.

* * * * *